US007179156B2

(12) United States Patent
Lin

(10) Patent No.: US 7,179,156 B2
(45) Date of Patent: Feb. 20, 2007

(54) GRINDER WITH EASILY INSTALLABLE/DETACHABLE GRINDING DISC AND A LINKAGE EFFECT

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 135 days.

(21) Appl. No.: 11/086,463

(22) Filed: Mar. 23, 2005

(65) Prior Publication Data

US 2006/0217045 A1 Sep. 28, 2006

(51) Int. Cl.
*B24B 23/00* (2006.01)

(52) U.S. Cl. ..... 451/359; 451/344

(58) Field of Classification Search ..... 451/342, 451/344, 359, 353, 360, 357, 358
See application file for complete search history.

(56) References Cited

U.S. PATENT DOCUMENTS 2,211,216 A * 8/1940 Oster ..... 451/358
3,872,951 A * 3/1975 Hastings, Jr. ..... 188/69
4,400,995 A * 8/1983 Palm ..... 74/527
4,989,374 A * 2/1991 Rudolf et al. ..... 451/342
5,199,223 A * 4/1993 Rudolf et al. ..... 451/342
6,752,704 B1 * 6/2004 Lin ..... 451/295
6,860,792 B2 * 3/2005 Krondorfer et al. ..... 451/8
6,887,141 B1 * 5/2005 Lin ..... 451/357
7,014,548 B1 * 3/2006 Lin ..... 451/359
7,052,384 B2 * 5/2006 Wolf et al. ..... 451/358
2002/0115394 A1 * 8/2002 Krondorfer et al. ..... 451/342
2003/0190877 A1 * 10/2003 Gallagher et al. ..... 451/344
2004/0043714 A1 * 3/2004 Yi ..... 451/359

* cited by examiner

*Primary Examiner*—Eileen P. Morgan
(74) *Attorney, Agent, or Firm*—Troxell Law Office, PLLC

(57) ABSTRACT

A grinder with easily installable/detachable grinding disc and a linkage effect. The grinder includes a main body in which a rotary shaft is disposed for a grinding disc mounted under a bottom end of the rotary shaft. A controlling button is switchable for powering on or off the grinder. A linking member is connected with the rotary shaft. A chucking mechanism is mounted in the main body for chucking the linking member. The chucking mechanism has a linking relationship with the controlling button. After powered off, the chucking mechanism is operable to chuck the linking member and prevent the rotary shaft from rotating. At this time, a user can conveniently replace the grinding disc. During replacement of the grinding disc, it is impossible to switch on the controlling button. When the chucking mechanism releases the linking member. The controlling button can be switched on. At this time, it is impossible for the chucking mechanism to chuck the linking member.

17 Claims, 13 Drawing Sheets

GRINDER WITH EASILY INSTALLABLE/DETACHABLE GRINDING DISC AND A LINKAGE EFFECT

BACKGROUND OF THE INVENTION

The present invention is related to a grinder, and more particularly to a grinder in which the grinding disc can be easily replaced without using any tool. In addition, when replacing the grinding disc, the grinder is prevented from being powered on so as to avoid mis-operation.

A conventional grinder has a grinding disc mounted on a bottom section of the grinder. The grinding disc has a central threaded rod screwed with a rotary shaft of the grinder. The rotary shaft serves to drive the grinding disc to grind a work piece.

In operation, it is necessary to frequently replace the grinding disc. Conventionally, when replacing the grinding disc, a flat wrench is extended into the bottom of the grinder for clogging the rotary shaft of the grinder. Under such circumstance, the grinding disc can be unscrewed from the rotary shaft and taken off. Similarly, when installing the grinding disc, it is also necessary to fix the rotary shaft. Such replacement operation is quite inconvenient and time-consuming.

This inventor has developed various grinder structures in which the rotary shaft can be easily fixed for replacing the grinding disc without using any tool. However, it often takes place that when replacing the disc, the grinder is incautiously powered on. Under such circumstance, the components of the grinder may be damaged.

SUMMARY OF THE INVENTION

It is therefore a primary object of the present invention to provide a grinder with easily installable/detachable grinding disc and a linkage effect. The grinding disc of the grinder can be easily replaced without using any tool. In addition, when replacing the grinding disc, the grinder is prevented from being incautiously powered on so as to ensure safety.

The present invention can be best understood through the following description and accompanying drawings wherein:

DETAILED DESCRIPTION OF THE PREFERRED EMBODIMENTS

Figure 1:
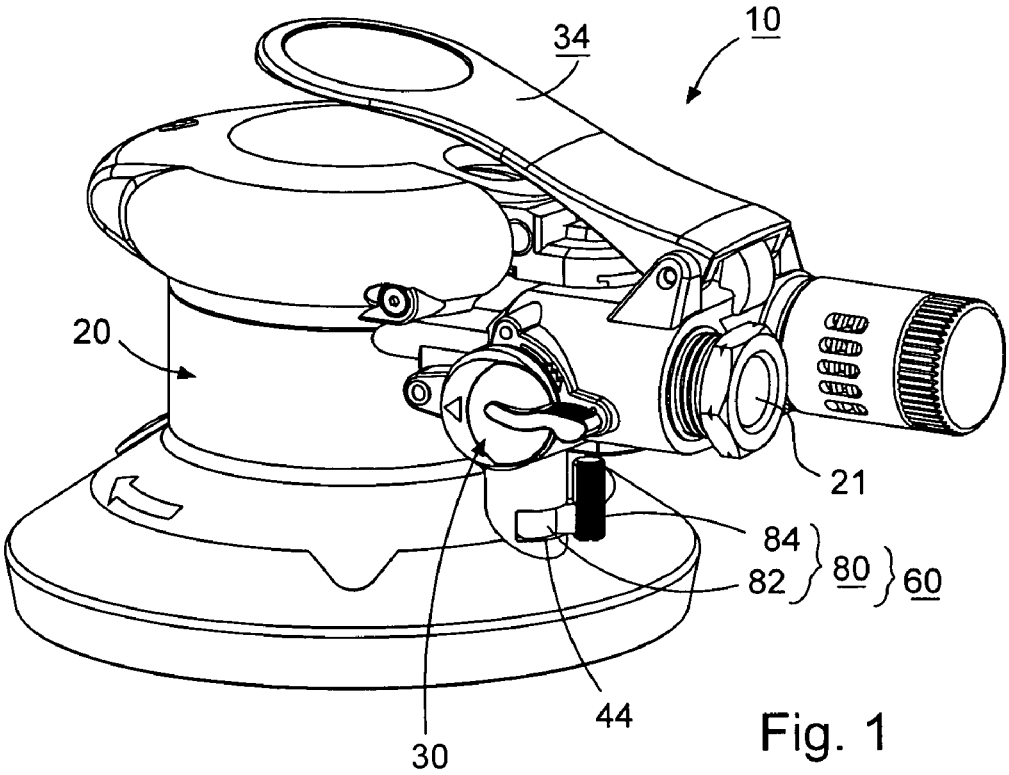
FIG. 1 is a rear perspective view of a preferred embodiment of the present invention.
Figure 2:
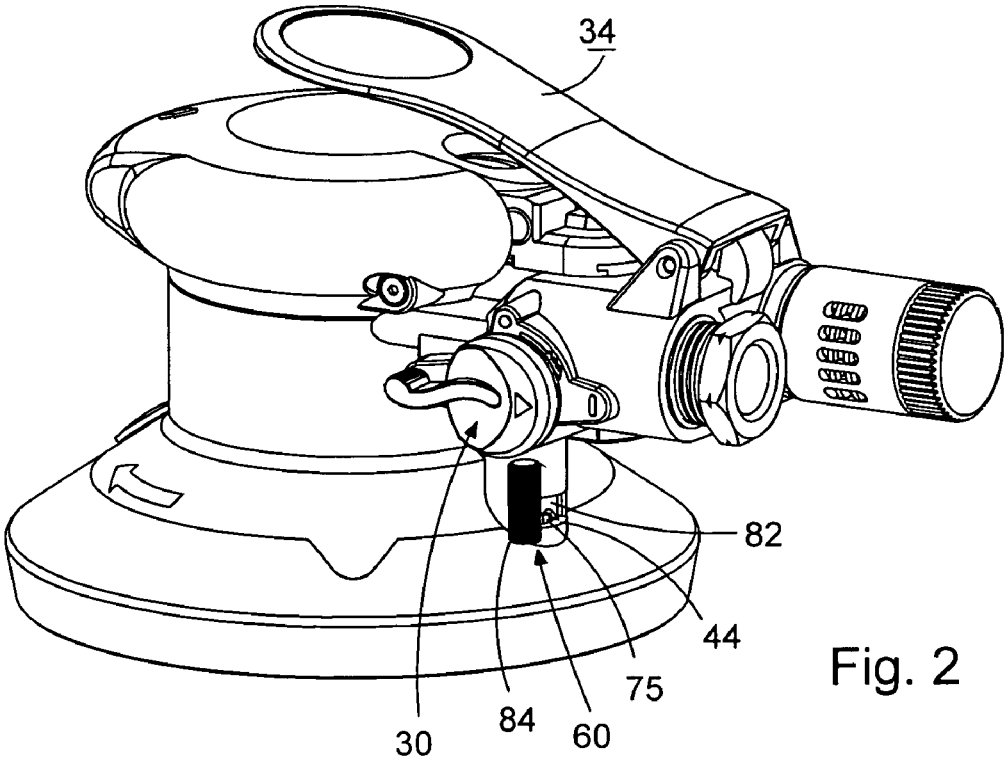
FIG. 2 is a longitudinally sectional view according to FIG. 1.

Please refer to FIGS. 1 and 2. According a first embodiment, the grinder of the present invention is a pneumatic grinder. Alternatively, the present invention is also applicable to an electric grinder.

The grinder 10 includes a main body 20. A rear end of the main body 20 has an air inlet 21 for connecting with a high-pressure air source. Referring to FIG. 2, the main body 20 is formed with an internal pneumatic cylinder chamber 22 in which a pneumatic cylinder 24 is mounted. A rotary shaft 28 is disposed on the bottom of the main body 20 and connected with a central shaft 26 of a rotor 25 of the pneumatic cylinder. A bottom end of the rotary shaft 28 is formed with a thread hole 29, whereby a grinding disc A (as shown by the phantom line) can be screwed with the rotary shaft. Referring to FIG. 1, a controlling button which is an intake button 30 (or an on-off switch for electric grinders) is movable between an activation position of FIG. 1 and a shutoff position of FIG. 3. When the intake button 30 is positioned in the activation position, the high-pressure air can flow into a flow way 31 inside the main body 20 (as shown in FIG. 2).

In use, as shown in FIG. 2, a user presses the trigger 34 to downward push a valve 36 and unblock the flow way 31. At this time, the high-pressure air flows into the cylinder chamber 22 to drive the rotor 25 of the pneumatic cylinder 24. The rotary shaft 28 is driven to drive the grinding disc A for grinding or buffering a work piece.

Figure 4:
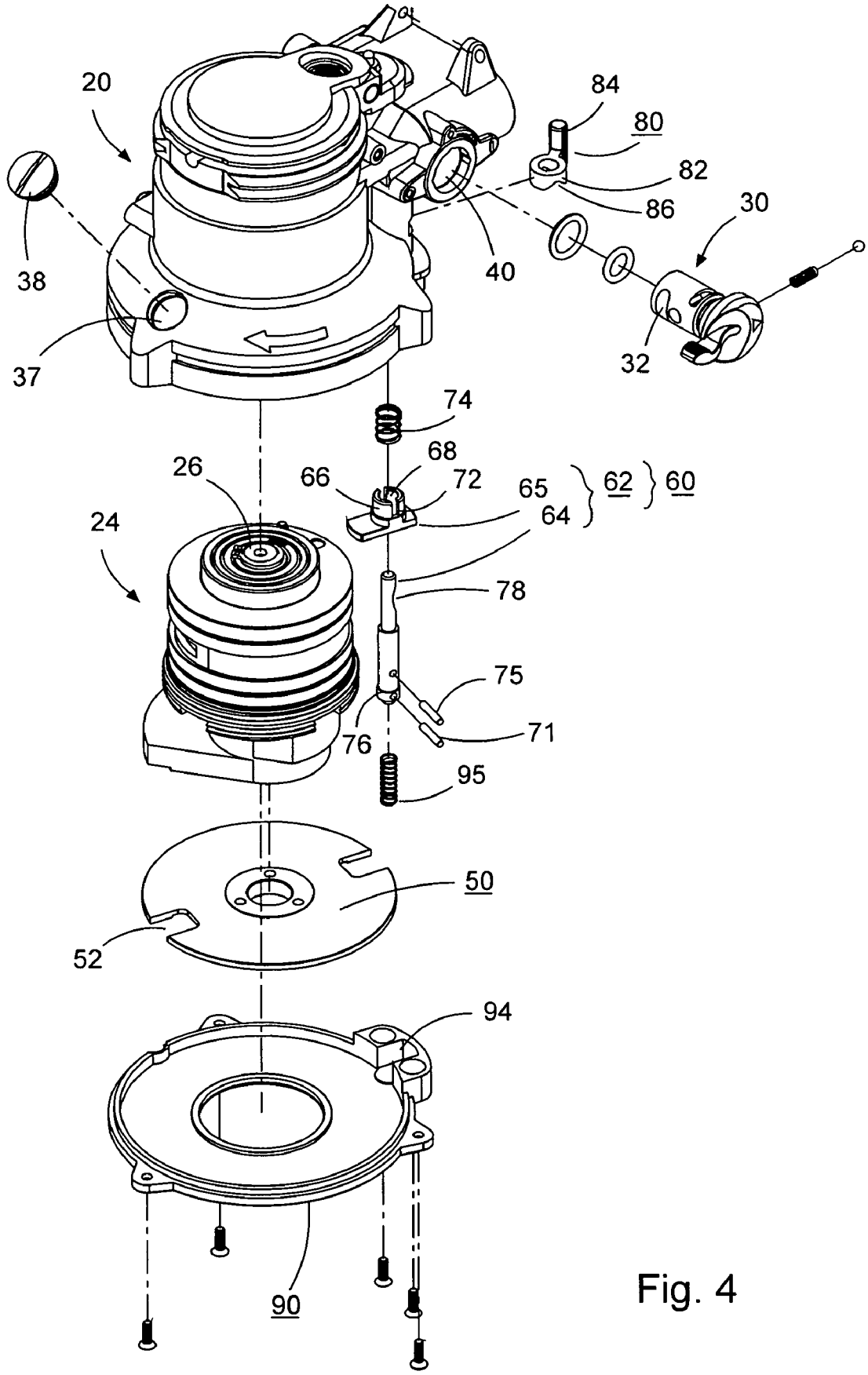
FIG. 4 is a perspective exploded view according to FIG. 1.
Figure 6:
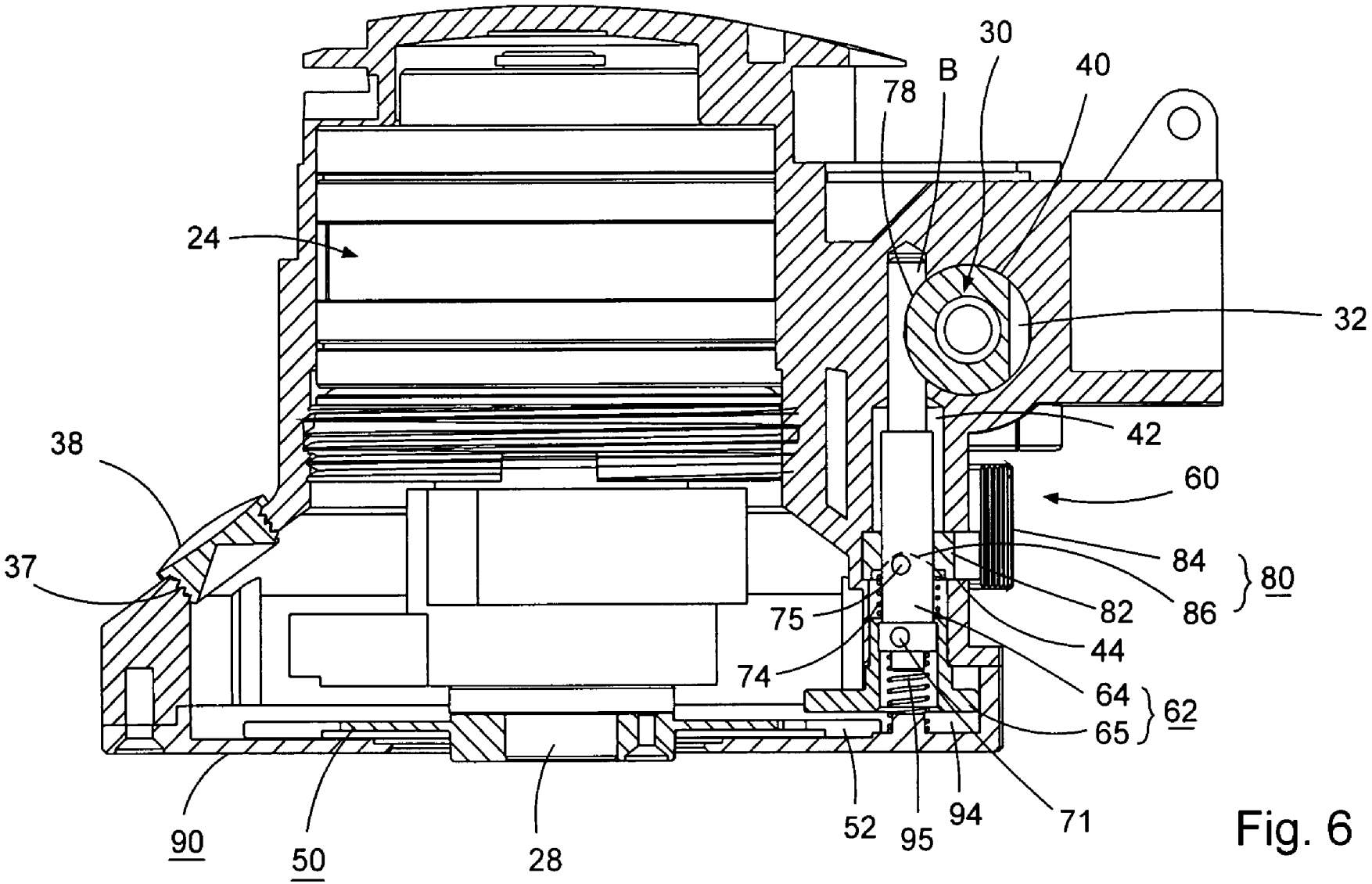
FIG. 6 is a sectional view taken along line 6—6 of FIG. 5, in which the trigger is not shown.

Referring to FIG. 4, a button room 40 is formed on one side of the main body 20. A vertical slide way 42 is formed in the main body as shown in FIG. 6. A bottom end of the slide way extends to the bottom end of the main body. A top end of the slide way communicates with the button room 40. An opening 44 is formed on the circumference of the main body 20 to communicate with the slide way 42 as shown in FIG. 1.

The intake button 30 is a rotary button disposed in the button room 40. The intake button 30 is partially exposed to outer side for a user to turn. A recess 32 is formed on the circumference of the intake button 30.

A linking member 50 is fixedly connected with bottom end of the rotary shaft 28 as shown in FIGS. 2 and 6. In this embodiment, the linking member 50 is a disc. Alternatively, the linking member can be an elongated plate or the like. The linking member 50 is rotatable with the rotary shaft. The circumference of the linking member is formed with several chucking sections 52.

Figure 8:
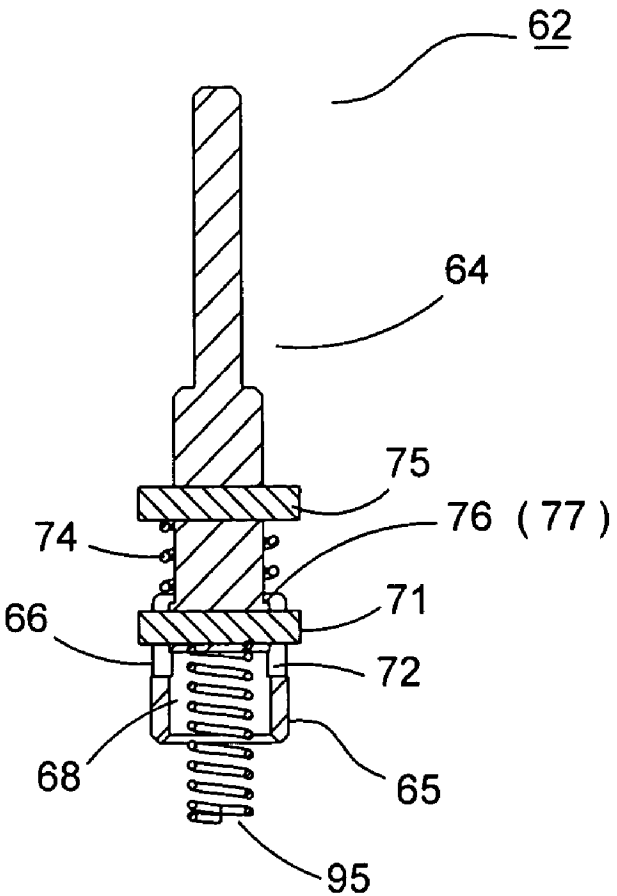
FIG. 8 is a sectional view taken along line 8—8 of FIG. 7.
Figure 7:
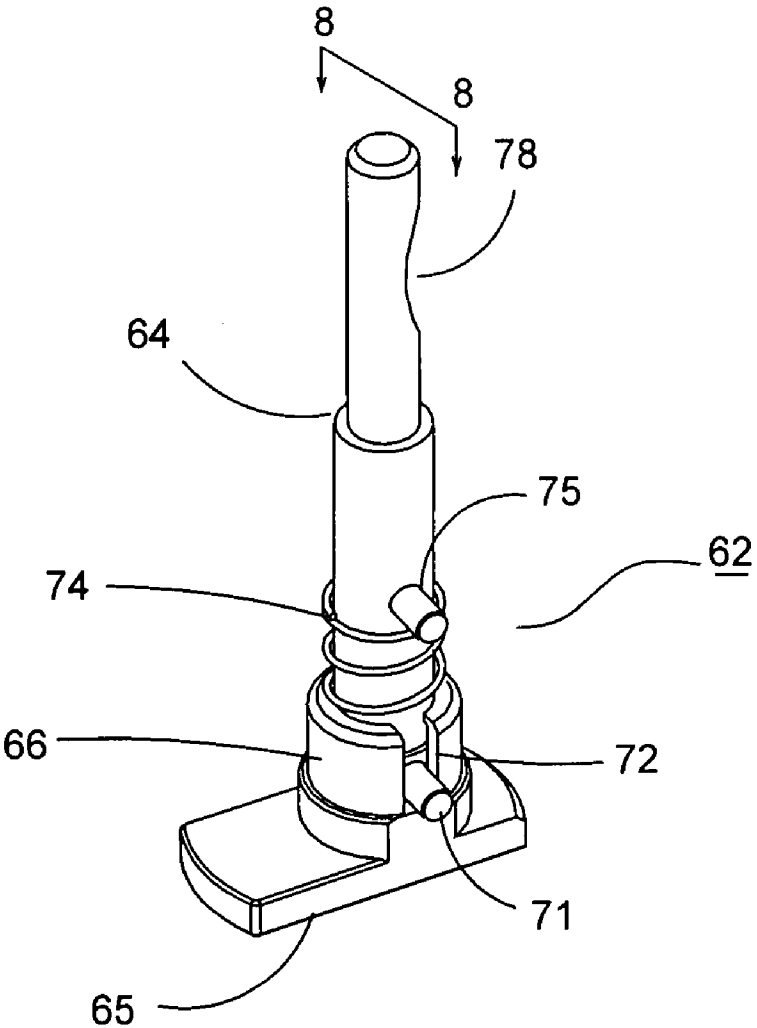
FIG. 7 is a perspective view of the chucking pillar of the preferred embodiment.

A chucking mechanism 60 is vertically movably mounted in the slide way 42 as shown in FIG. 6. The chucking mechanism 60 includes a chucking pillar 62 and a shift button 80 for controlling the chucking pillar 62. Referring to FIGS. 7 and 8, the chucking pillar has a pillar body 64 and a dogging section 65 disposed at bottom end of the pillar body 64. The pillar body 64 is fitted through a tunnel 68 of the dogging section 65. A fixing pin 71 is passed through the pillar body and inlaid in an insertion split 72 of the dogging section, whereby the pillar body will not rotate when moving within the tunnel 68. Two ends of a spring 74 respectively abut against a locating pin 75 of the pillar body 64 and the dogging section 65. An arc recess 78 is formed on the circumference of upper half of the pillar body 64.

By means of operating the shift button 80, the chucking pillar can be controlled to move up and down. The shift button and the chucking pillar cooperate with each other to achieve a cam effect. Referring to FIG. 4, the shift button 80 has a cylindrical button body 82 and a shift section 84 connected therewith. The bottom face of the button body 82 has a cam section 86. The button body 82 is fitted through the opening 44 of the main body 20 into the slide way 42 and fitted on the pillar body 64 of the chucking pillar 62. The cam section 86 contacts with the locating pin 75 of the chucking pillar. The shift section 84 is positioned outside the main body 20. The circumference of the intake button is snugly attached to the arc recess 78 of the chucking pillar 62. In this position, the bottom end of the chucking pillar is higher than the linking member 50.

A base seat 90 is fixedly connected with bottom end of the main body 20. The dogging section 65 of the chucking pillar 62 is accommodated in a dent 94 of the base seat, whereby the chucking pillar can only move up and down without possibility of rotation. A lifting spring 95 is disposed in the dent of the base seat for lifting the chucking pillar 62 as shown in FIG. 6.

In common use, the intake button 30 of the grinder is switched to the activation position as shown in FIGS. 1 and 6. At this time, the power source is turned on, permitting the high-pressure air to flow into the main body. When pressing the trigger, the pneumatic cylinder 24 is driven to drive the rotary shaft 28, the linking member 50 and the grinding disc to synchronously rotate for grinding or buffering a work piece. The shift button 80 of the chucking mechanism 60 is positioned in the releasing position as shown in FIG. 1. Referring to FIG. 6, the recess of the cam section 86 contacts with the locating pin 75 of the chucking pillar 62 and the arc recess 78 of the chucking pillar 62 is engaged with the intake button 30.

Figure 3:
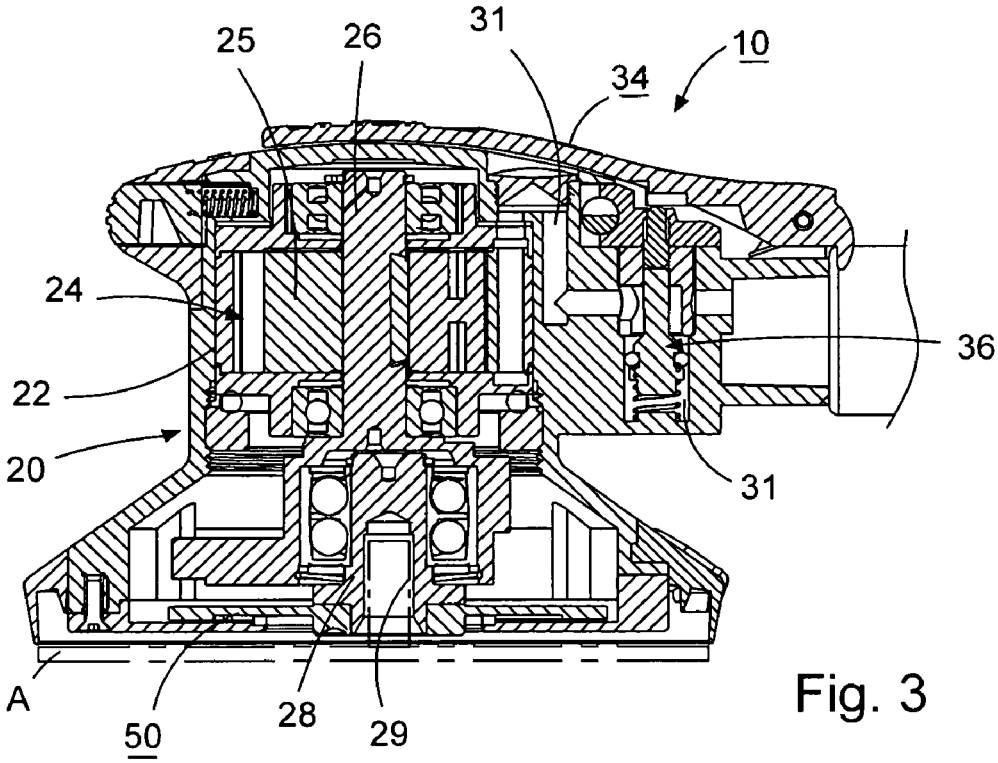
FIG. 3 is another rear perspective view of the preferred embodiment of the present invention, showing that the controlling button is switched to a shutoff position and the shift button of the chucking mechanism is positioned in a chucking position.
Figure 5:
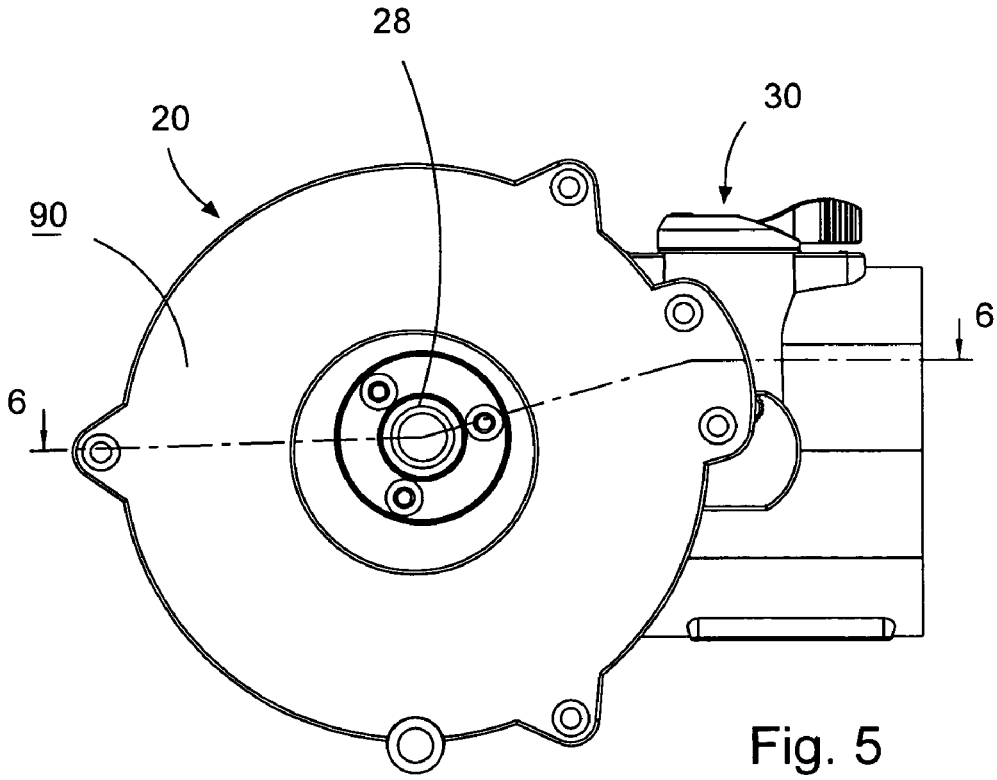
FIG. 5 is a bottom view according to FIG. 1.
Figure 10:
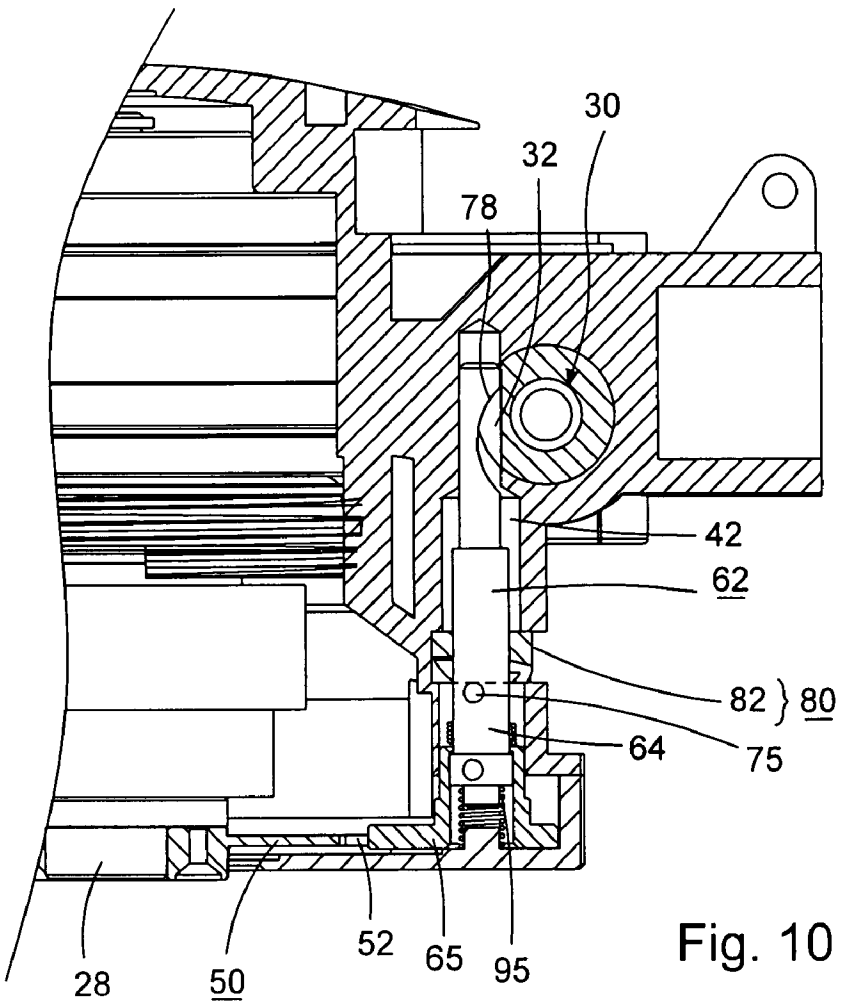
FIGS. 9 to 11 are similar to FIG. 6, showing the operation of the present invention and the cooperation relationship between the components of the present invention.
Figure 9:
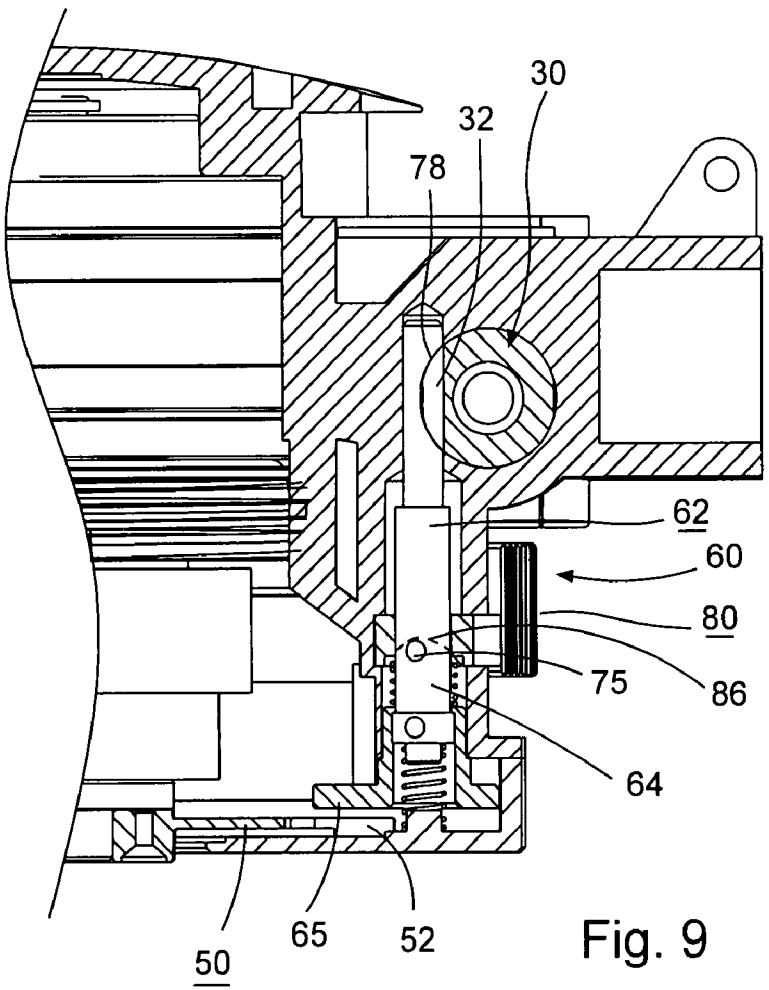

When replacing the grinding disc, the present invention provides an idleproof and security linkage effect. A user must first shut off the power source and switch the intake button 30 to the shutoff position as shown in FIGS. 3 and 9, whereby the recess 32 is aligned with the chucking pillar 62. At this time, the arc recess 78 of the chucking pillar is free from the body of the intake button and thus is freely movable. Then the shift button 80 is turned to the engaging position as shown in FIGS. 3 and 10. After the shift button is angularly displaced, the plane face of the bottom end of the cam section 86 contacts with the locating pin 75 of the chucking pillar 62 to drive and move the chucking pillar downward to an engaging position. At this time, the dogging section 65 of the bottom end of the chucking pillar is chucked in the chucking section 52 of the linking member 50. Under such circumstance, the rotary shaft 28 is located without possibility of rotation, whereby the user can replace the grinding disc.

Referring to FIG. 10, the grinder is powered off so that when replacing the grinding disc, in the case that the user incautiously touches the trigger, the grinder will not be activated. Therefore, the mis-operation of the grinder is avoided to ensure safety. Also, the components of the grinder are protected from being damaged.

After the replacement is completed, the user must turn the shift button 80 back to the releasing position of FIG. 9. At this time, the chucking pillar 62 is pushed upward by the lifting spring 95 and restored to the releasing position. Then the intake button 30 is switched back to the activation position of FIG. 6 so as to restart the grinder.

The protection design of the present invention is such that after the grinding disc is replaced, in the case that the user fails to restore the chucking mechanism and the intake button to the state of FIG. 6, that is, the grinder is still in the state of FIG. 10 and the user doesn't notice that and intends to switch the intake button back to the activation position for activating the grinder, since the chucking pillar 62 chucks the recess 32 of the intake button 30, therefore, it is impossible to switch the intake button. This idleproof measure reminds the user to first restore the chucking pillar to the releasing position and then switches the intake button back to the activation position. Accordingly, with the linking member 50 still chucked, the grinder is prevented from being incautiously powered on by the user.

Similarly, when replacing the grinding disc, in the case that the intake button 30 is still in the activation position of FIG. 6 without being switched to the shutoff position of FIGS. 9 and 10, the chucking mechanism 60 cannot be moved to chuck the linking member 50. Therefore, it is ensured that before the grinder is powered off, the rotary shaft and the linking member will not be locked due to mis-operation.

Figure 11:
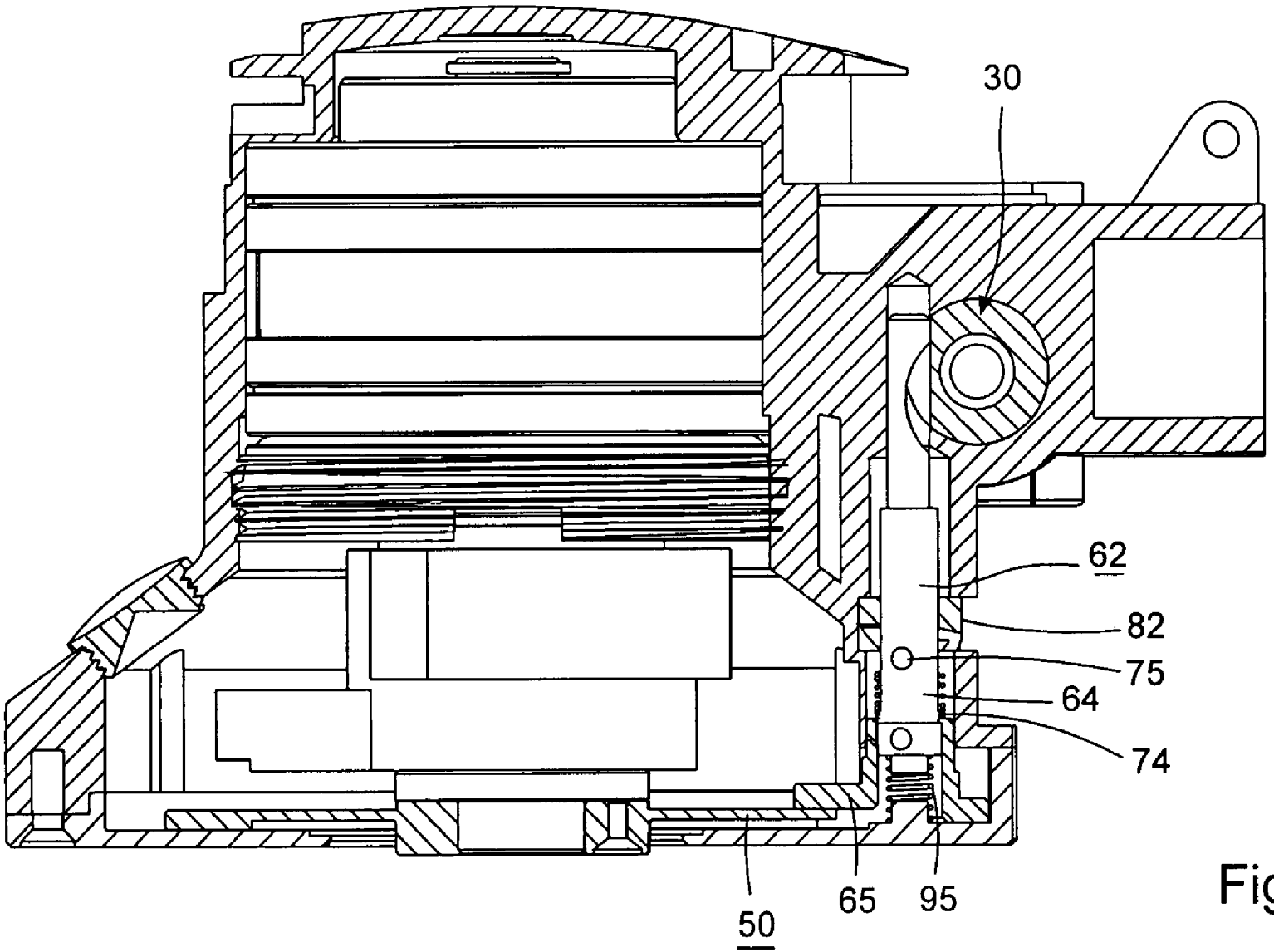

Moreover, in the case that the chucking section 52 of the linking member 50 is not positioned right under the chucking pillar 62, the chucking mechanism 60 can be still operated to the engaging position. At this time, as shown in FIG. 11, the pillar body 64 of the chucking pillar is moved downward. When the dogging section 65 touches the top face of the linking member 50, the pillar body 64 stops moving. Thereafter, the grinding disc is manually rotated to rotate the linking member 50. When the chucking section 52 is moved to a position right under the chucking pillar 62 as shown in FIG. 10, the dogging section 65 is pushed by the spring 74 to move downward into the chucking section 52 to chuck the linking member.

Figure 13:
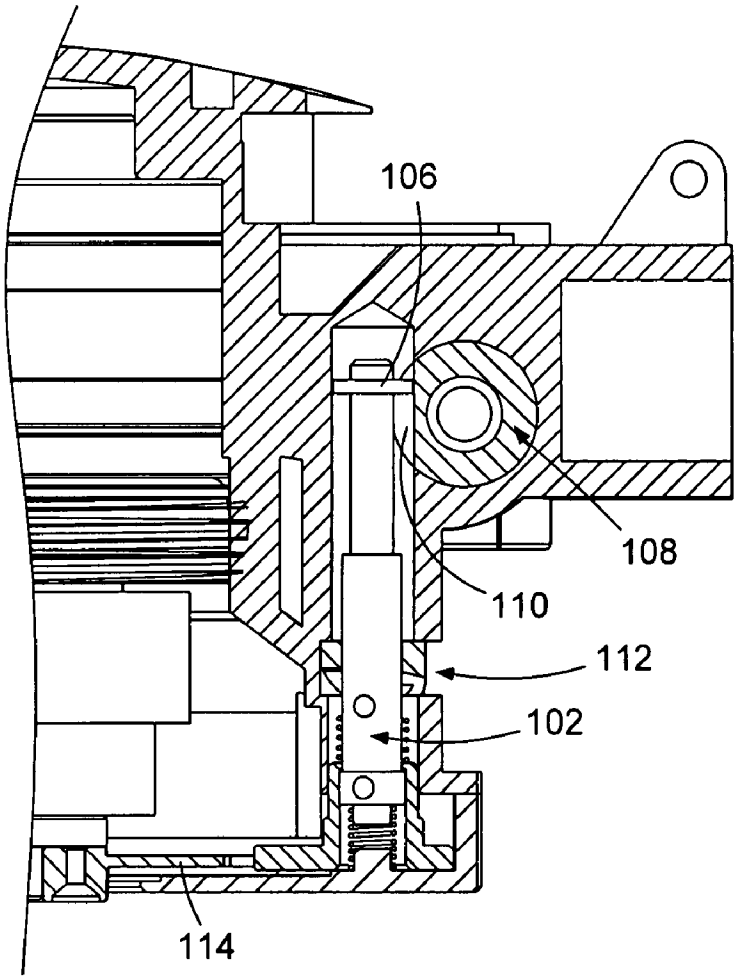
FIGS. 12 and 13 are sectional views of another embodiment of the present invention, respectively showing the engaging position and releasing position thereof.
Figure 12:
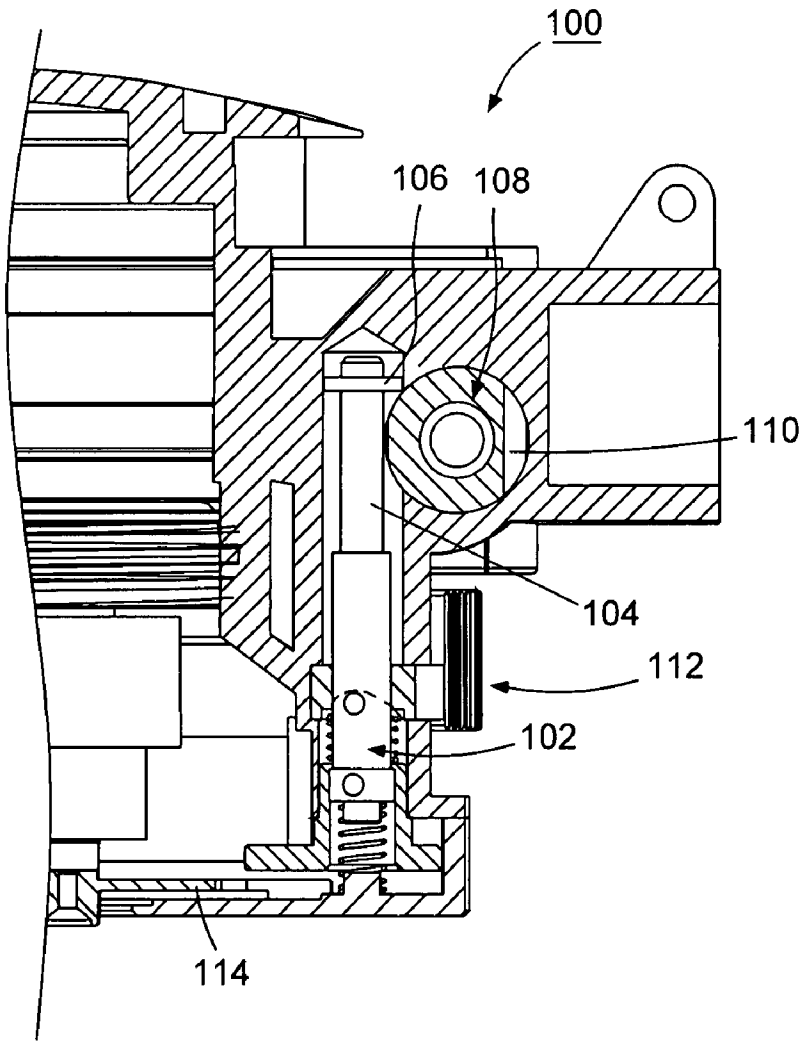

FIGS. 12 and 13 show another embodiment of the grinder 100 of the present invention, in which the pillar body 104 of the chucking pillar 102 is free from any arc recess. Instead, the pillar body 104 is formed with a projecting stop section 106. When the intake button 108 is positioned in the activation position of FIG. 12, the stop section 106 is stopped by the body of the intake button, whereby the chucking pillar 102 cannot move downward to the engaging position.

Reversely, as shown in FIG. 13, when the intake button 108 is switched to the shutoff position, the recess 110 is aligned with the chucking pillar 102 and the stop section 106 is not stopped. Therefore, by means of turning the shift button 112, the chucking pillar is driven and moved downward to the engaging position for chucking the linking member 114. It should be noted that in the embodiment of FIG. 6, the section B of the chucking pillar 62 above the arc recess 78 is also a structure equivalent to the stop section.

Figure 14:
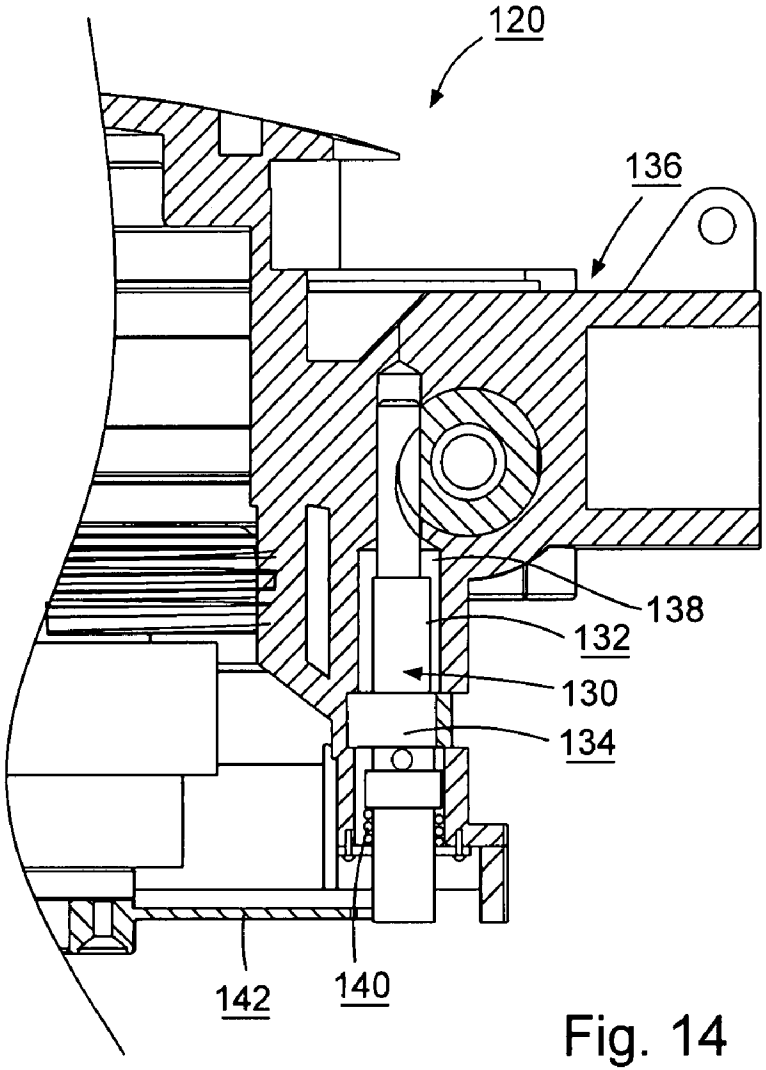
FIG. 14 is a sectional view of still another embodiment of the present invention.
Figure 16:
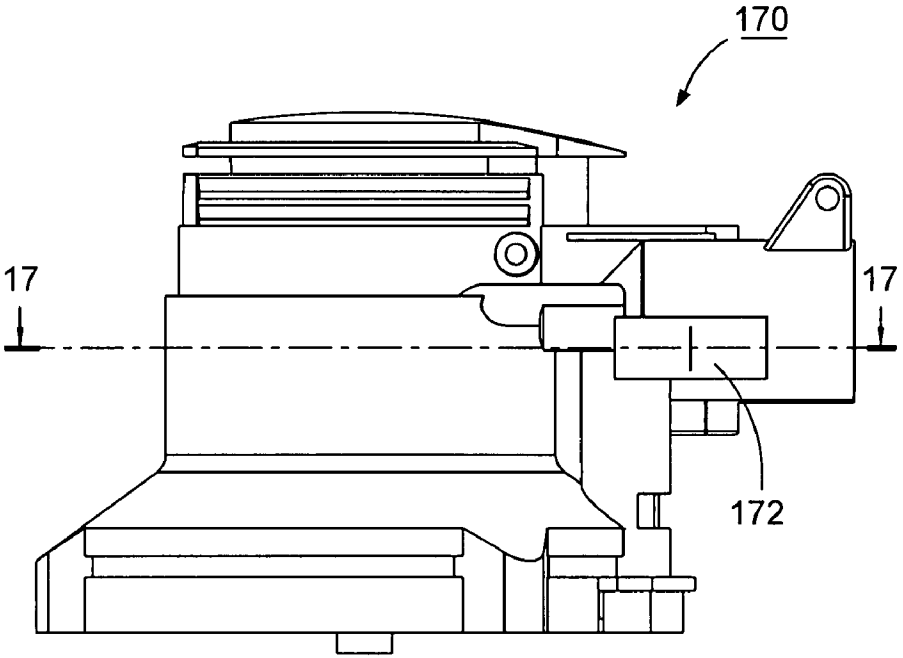
FIG. 16 is a right view of still another embodiment of the present invention.

FIG. 14 is still another embodiment of the grinder 120 of the present invention, in which the chucking mechanism 130 also includes a chucking pillar body 132 and a shift button 134. The shift button is totally identical to that of FIG. 4. The chucking pillar is movable within the slide way 138 of the main body 136.

FIG. 14 shows that the shift button 134 drives the chucking pillar 132 downward to the engaging position for chucking the linking member 142. When the shift button is restored to the releasing position, the chucking pillar 132 is pushed by a lifting spring 140 to restore to the releasing position so as to release the linking member from the chucked state.

Figure 15:
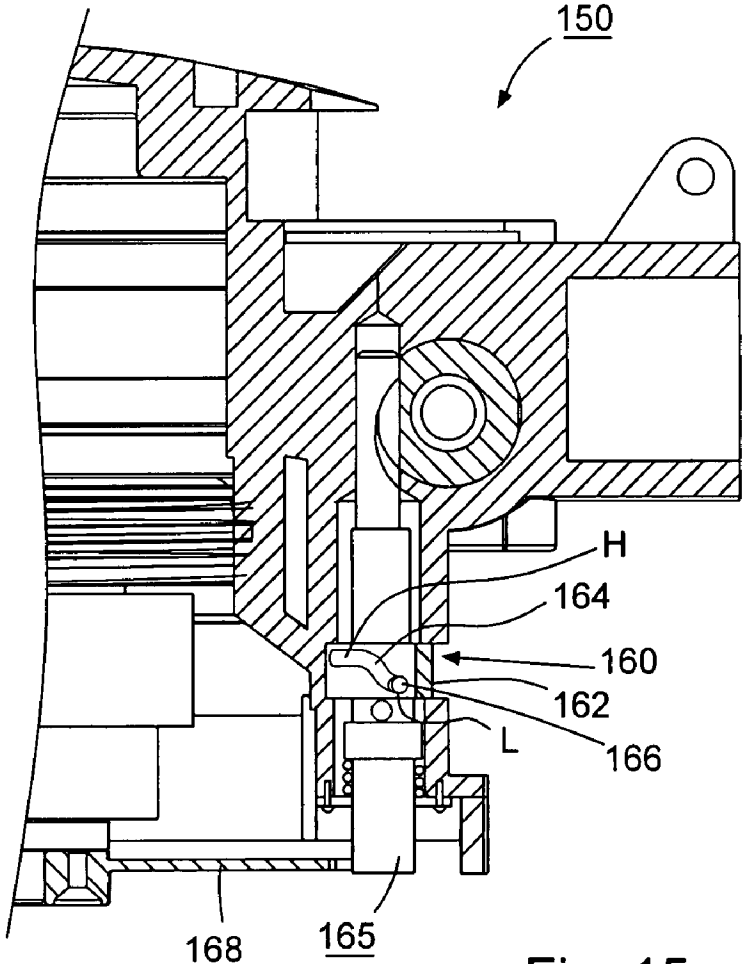
FIG. 15 is a sectional view of still another embodiment of the present invention.

FIG. 15 shows still another embodiment of the grinder 150 of the present invention, in which the shift button 160 also has a shift section (not shown) and a cylindrical button body 162. The locating pin 166 of the chucking pillar 165 is fitted in a guide slot 164 of the button body 162. The chucking pillar can only vertically move within the slide way without possibility of rotation. By means of turning the shift button 160, the locating pin 166 of the chucking pillar is moved to a lower end L of the guide slot 164. At this time, the chucking pillar 165 is moved downward to chuck the linking member 168. Reversely, when the shift button 160 is turned to the releasing position, the locating pin 166 of the chucking pillar 165 is moved to the higher end H of the guide slot, the chucking pillar is moved upward to release the linking member.

Figure 18:
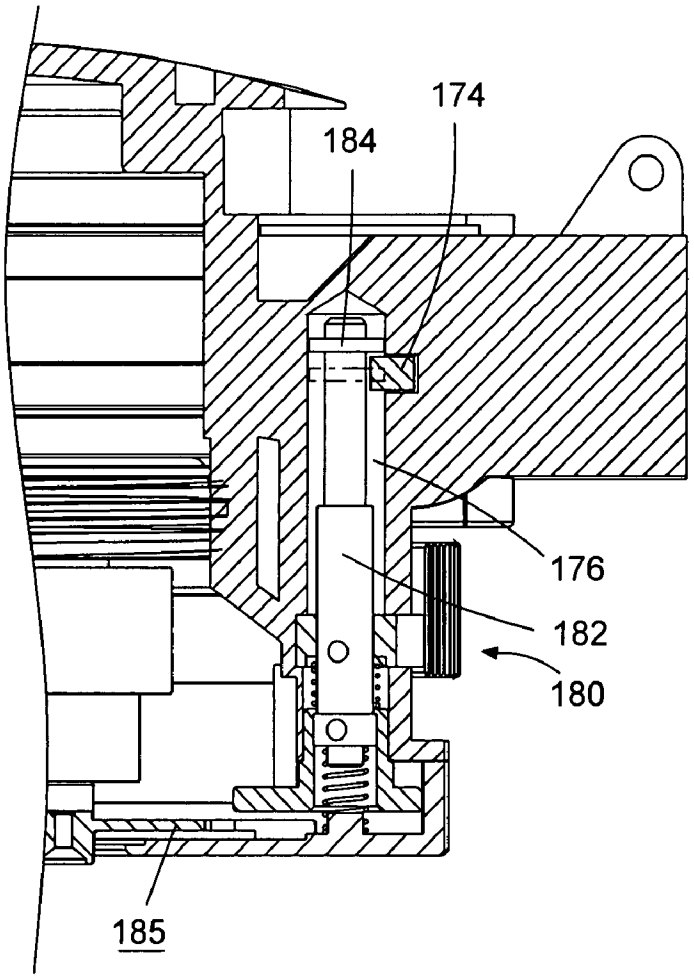
FIG. 18 is a sectional view taken along line 18—18 of FIG. 17.
Figure 17:
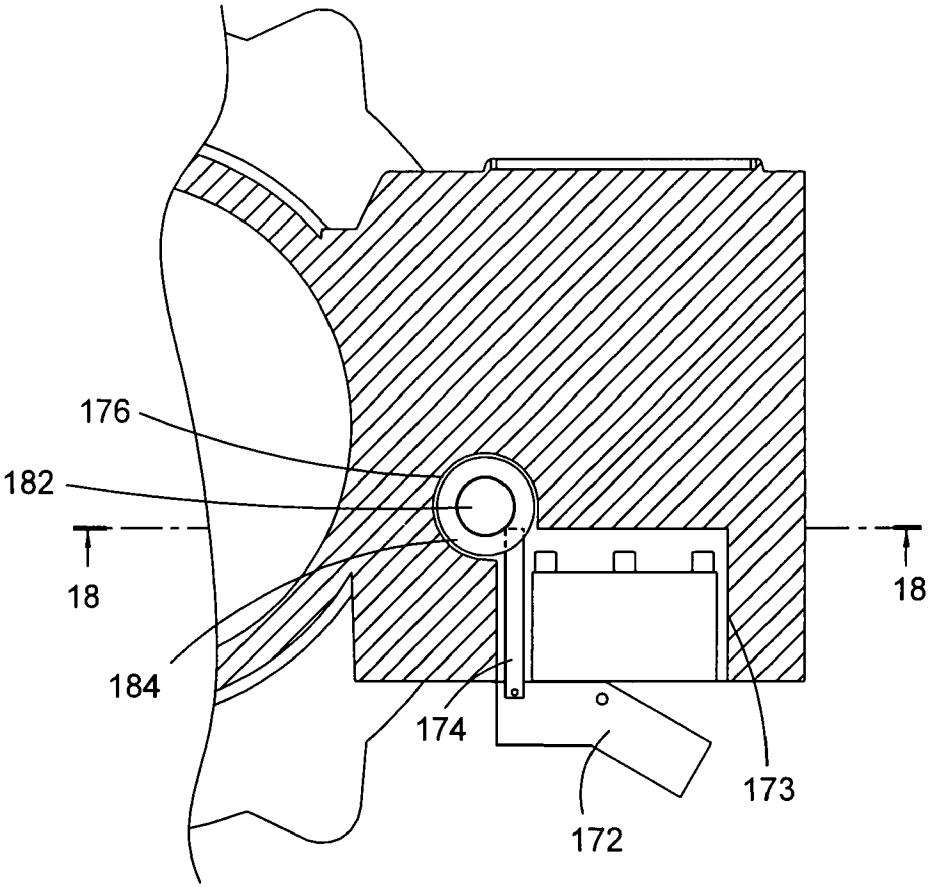
FIG. 17 is a sectional view taken along line 17—17 of FIG. 16.
Figure 19:
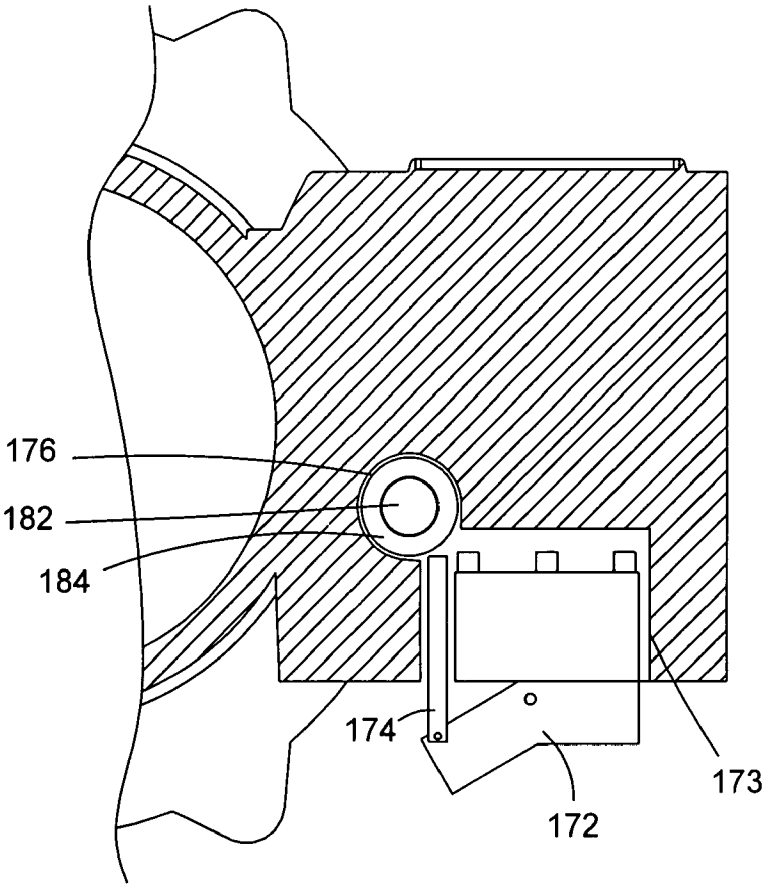
FIG. 19 is similar to FIG. 17, showing the operation thereof.

FIGS. 16 to 19 show still another embodiment of the present invention, in which the grinder 170 is an electric grinder. A controlling button (electric switch) is mounted in a button room 173. When the controlling button 172 is switched on as shown in FIG. 17, the grinder is powered on. When the controlling button 172 is switched off as shown in FIG. 19, the grinder is powered off. An outer end of a link 174 is pivotally connected with the controlling button 172. When the controlling button 172 is switched on, the link 174 is driven and positioned in a stop position, an inner end of which extends into the slide way 176 as shown in FIG. 17. The stop section 184 of the chucking pillar 182 of the chucking mechanism 180 is stopped by the inner end of the link as shown in FIG. 18. Therefore, the chucking pillar 182 cannot be moved downward. Reversely, when the controlling button 172 is switched off, the link 174 is positioned in a releasing position with the inner end moving out of the slide way 176 as shown in FIG. 19, the chucking pillar 182 is not stopped by the link, whereby a user can move the chucking pillar 182 downward to chuck the linking member 185.

Moreover, when the chucking pillar 182 is moved downward to the engaging position, the stop section 184 is positioned at a height shown by phantom line of FIG. 18 to stop the inner end of the link 174, and the link cannot be moved into the slide way 176. Accordingly, when replacing the grinding disc, the grinder cannot be powered on.

Figure 20:
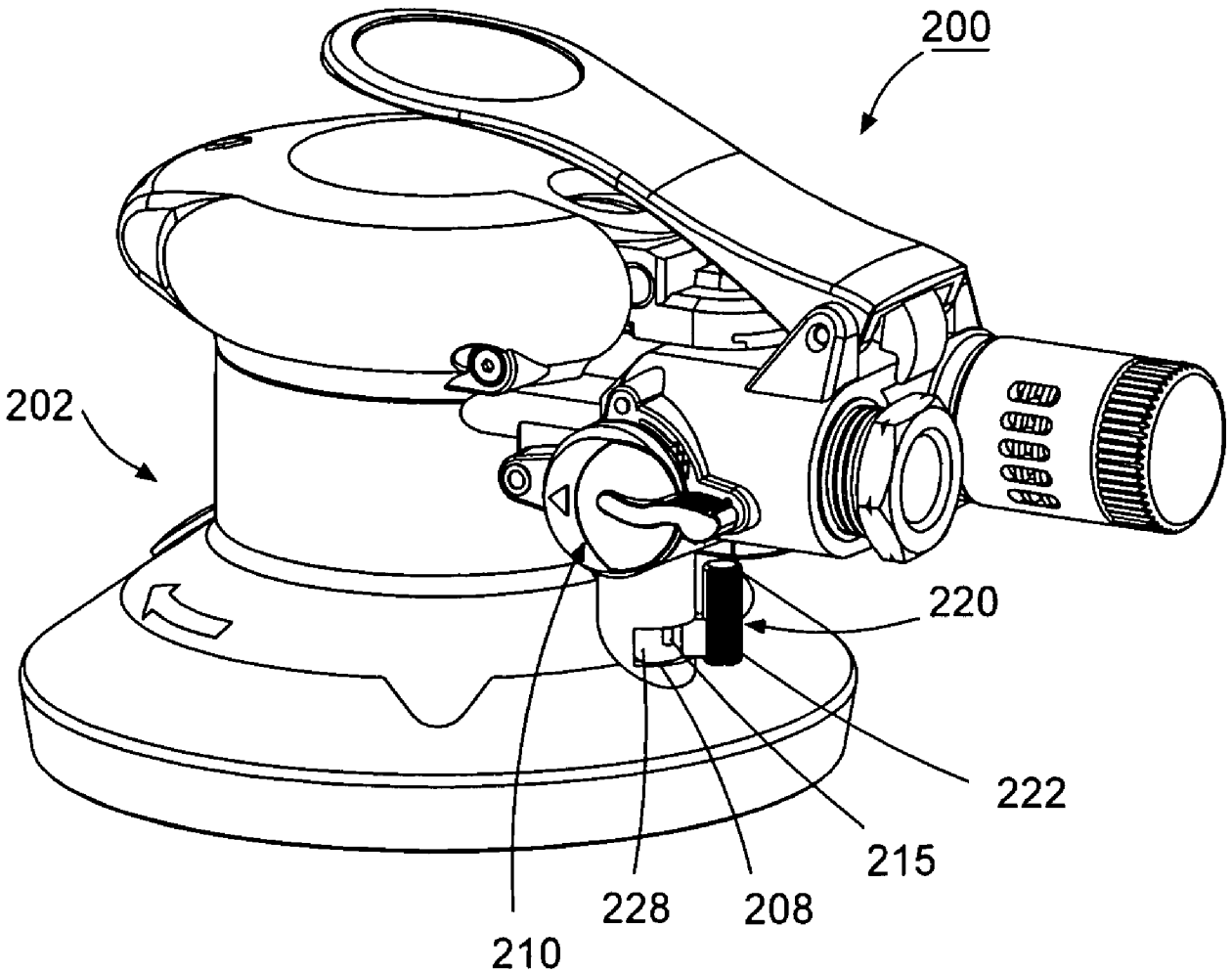
FIG. 20 is a rear perspective view of still another embodiment of the present invention.
Figure 22:
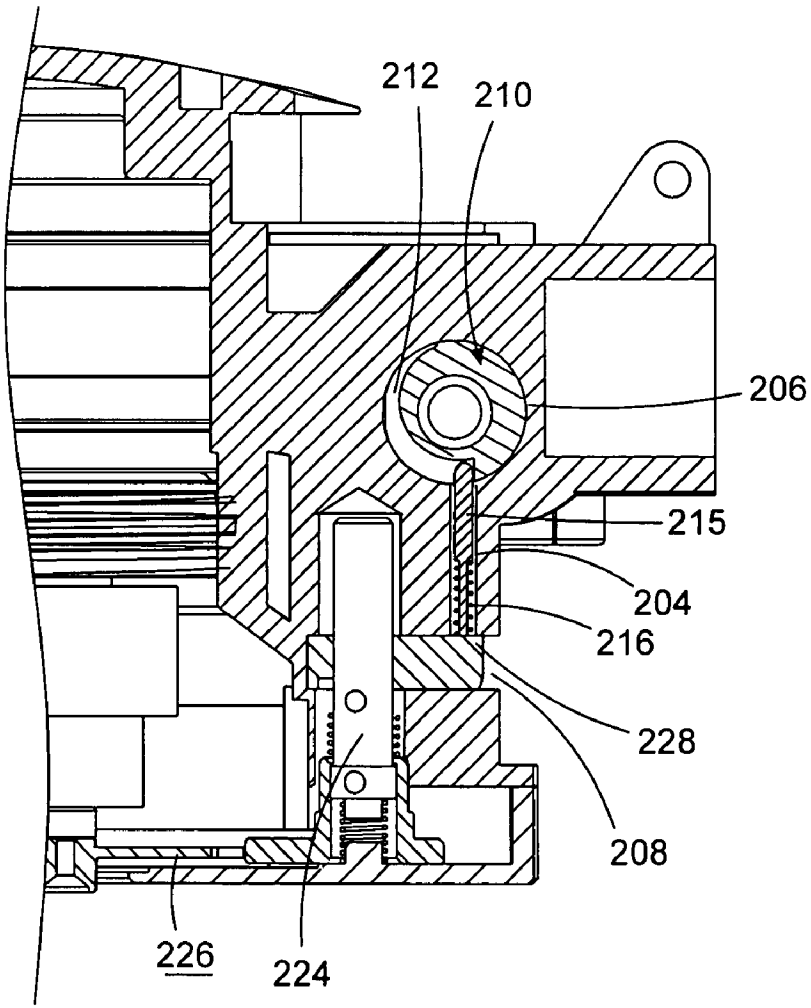
FIG. 22 is similar to FIG. 21, showing the operation thereof.
Figure 21:
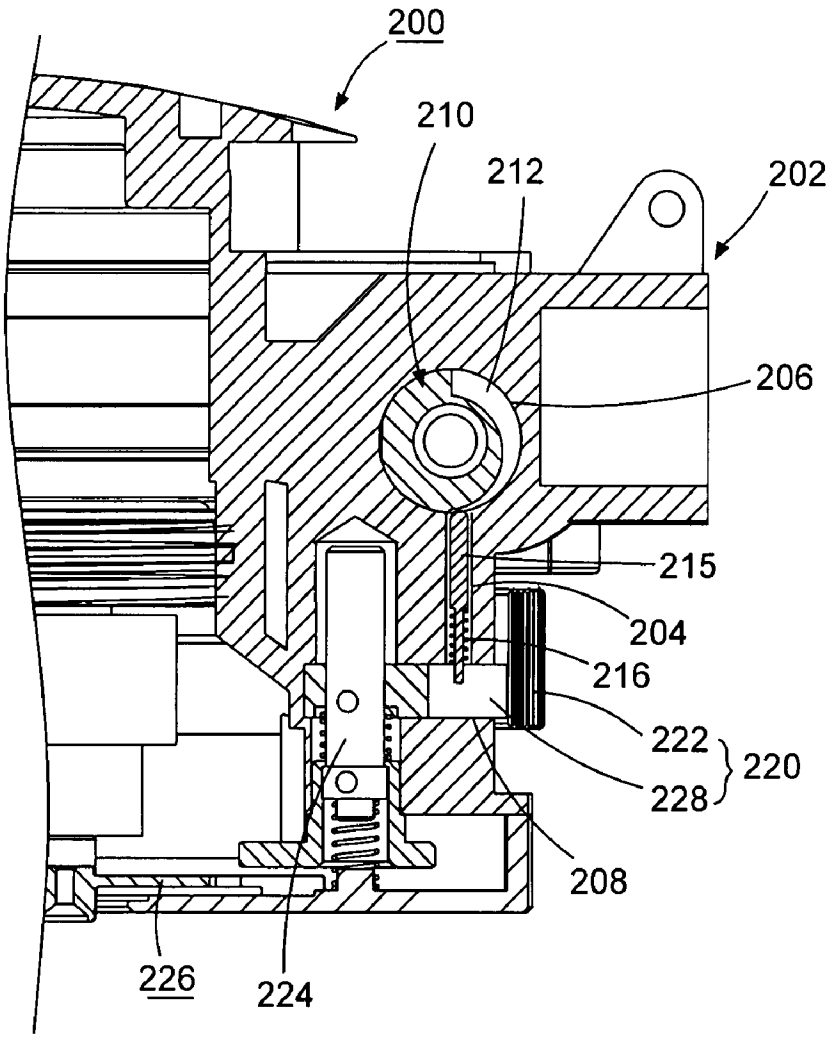
FIG. 21 is a sectional view according to FIG. 20.

FIGS. 20 to 22 show still another embodiment of the present invention, in which the chucking mechanism can be any of those of the above embodiments. Referring to FIG. 21, the circumference of the controlling button 210 is formed with a radial conic guide channel 212. The depth of the guide channel is tapered from one end to the other end. In addition, a small slide way 204 is formed in the main body 202 of the grinder 200 to communicate with the button room 206 and an opening 208 of rear side of the main body. A link 215 is disposed in the small slide way 204 and movable along the small slide way. A spring 216 is disposed in the small slide way. In normal state, the spring 216 lifts the link 215.

When the controlling button 210 is positioned in the activation position as shown in FIGS. 20 and 21, the link 215 is positioned in a stop position with bottom end protruding into the opening 208. Under such circumstance, the shift section 222 of the shift button 220 is stopped by the link 215, whereby a user cannot operate the chucking mechanism.

When the controlling button 210 is positioned in the shutoff position as shown in FIG. 22, the deeper end of the guide channel 212 is aligned with the small slide way 204. The link 215 is pushed upward by the spring 216 to a releasing position and the top end of the link 215 is moved into the deeper end of the guide channel 212. Under such circumstance, the bottom end of the link no more stops the shift button 220, permitting a user to shift the shift button to the engaging position, whereby the chucking pillar 224 is moved downward to chuck the linking member 226. At the same time, the bottom end of the link is stopped by the button body 228 of the shift button from moving downward so that the user cannot switch on the controlling button.

Besides, referring to FIGS. 4 and 6, the main body 20 is formed with a through hole 37 communicating with the interior of the main body. A cock 38 is screwed in the through hole. In the case of failure of the chucking mechanism, a user can take off the cock 38 and extend an iron bar through the through hole 37 into the main body for chucking the chucking section 52 of the linking member 50. At this time, the grinding disc can be replaced.

According to the above arrangement, the rotary shaft can be easily fixed without using any tool. Therefore, it is more convenient to replace the grinding disc. Also, the present invention is equipped with a linkage mechanism. Before the grinder is powered off, it is impossible to chuck the rotary shaft. Moreover, during replacement of the grinding disc, it is impossible to power on the grinder. Accordingly, when replacing the grinding disc, the grinder is prevented from being incautiously activated; when the rotary shaft is chucked, the grinder will not be activated so as to avoid danger and injury as well as damage of the grinder.

The above embodiments are only used to illustrate the present invention, not intended to limit the scope thereof. Many modifications of the above embodiments can be made without departing from the spirit of the present invention.

What is claimed is:

1. A grinder with easily installable/detachable grinding disc and a linkage effect, comprising:

a main body in which a rotary shaft is disposed for a grinding disc being mounted under a bottom end of the rotary shaft and drivable by the rotary shaft;

a controlling button mounted on the main body and switchable between an activation position and a shutoff position for powering on or off the grinder;

a linking member connected with the rotary shaft and synchronously rotatable therewith; and a chucking mechanism mounted in the main body and movable between an engaging position and a releasing position, whereby when the chucking mechanism is moved to the engaging position, the chucking mechanism chucks the linking member, while when the chucking mechanism is moved to the releasing position, the chucking mechanism releases the linking member from the chucked state; the controlling button having a linkage function with the chucking mechanism, whereby when the controlling button is positioned in the activation position, the chucking mechanism is positioned in the releasing position and cannot be moved to the engaging position, while when the controlling button is positioned in the shutoff position, the chucking mechanism can be moved from the releasing position to the engaging position where the controlling button cannot be switched to the activation position.

2. The grinder with easily installable/detachable grinding disc and the linkage effect as claimed in claim 1, wherein the chucking mechanism is up and down movable, whereby when the chucking mechanism is moved upward, the chucking mechanism is moved to the releasing position, while when the chucking mechanism is moved downward, the chucking mechanism is moved to the engaging position.

3. The grinder with easily installable/detachable grinding disc and the linkage effect as claimed in claim 1, further comprising a link disposed between the controlling button and the chucking mechanism, whereby by means of the link, the controlling button and the chucking mechanism can be engaged with each other or disengaged from each other.

4. The grinder with easily installable/detachable grinding disc and the linkage effect as claimed in claim 3, wherein a first end of the link is connected with the controlling button and is driven by the controlling button, a second end of the link corresponds to the chucking mechanism, whereby when the controlling button is positioned in the activation position, the link is positioned in a stop position where the chucking mechanism is stopped by the link and kept in the releasing position without possibility of moving to the engaging position; while when the controlling button is positioned in the shutoff position, the link is moved to a releasing position where the chucking mechanism is not stopped and can be moved, when the chucking mechanism is moved to the engaging position, the link being stopped by the chucking mechanism from moving to the stop position.

5. The grinder with easily installable/detachable grinding disc and the linkage effect as claimed in claim 4, wherein the chucking mechanism includes a chucking pillar and a shift button, the chucking pillar being disposed in the main body, by means of operating the shift button, the chucking pillar being movable between the engaging position and the releasing position, when the link is positioned in the stop position, the chucking pillar being stopped.

6. The grinder with easily installable/detachable grinding disc and the linkage effect as claimed in claim 5, wherein the main body is formed with an internal slide way in which the chucking pillar is movably disposed, a stop section being formed on the chucking pillar, the second end of the link being extendable into the slide way, whereby when the link is positioned in the stop position, the second end of the link extends into the slide way to stop the stop section, while when the link is positioned in the releasing position, the second end of the link moves out of the slide way to free the stop section, when the chucking pillar is moved to the engaging position, the stop section stopping the link from moving into the slide way.

7. The grinder with easily installable/detachable grinding disc and the linkage effect as claimed in claim 4, wherein the chucking mechanism includes a chucking pillar and a shift button, the chucking pillar being disposed in the main body, by means of operating the shift button, the chucking pillar being movable between the engaging position and the releasing position, when the link is positioned in the stop position, the shift button being stopped.

8. The grinder with easily installable/detachable grinding disc and the linkage effect as claimed in claim 7, wherein the shift button is connected with the chucking pillar and exposed to outer side of the main body, when the shift button is positioned in a first position, the chucking pillar being driven and positioned in the releasing position, when the shift button is positioned in a second position, the chucking pillar being driven and positioned in the engaging position, when the link is positioned in the stop position, the link chucking the shift button and keeping the shift button in the first position, when the link is positioned in the releasing position, the shift button being released and movable to the second position where the shift button stops the link from moving to the stop position.

9. The grinder with easily installable/detachable grinding disc and the linkage effect as claimed in claim 8, wherein the main body is formed with an opening and a small slide way is formed in the main body, one end of the small slide way communicating with the opening, the shift button being exposed to outer side of the main body through the opening, the link being movably disposed in the small slide way, when the link is positioned in the stop position, the second end of the link protruding into the opening, when the link is positioned in the releasing position, the second end of the link being moved out of the opening.

10. The grinder with easily installable/detachable grinding disc and the linkage effect as claimed in claim 9, wherein a button room is formed in the main body, the other end of the small slide way communicating with the button room, the controlling button being disposed in the button room, the first end of the link being driven by the controlling button.

11. The grinder with easily installable/detachable grinding disc and the linkage effect as claimed in claim 10, wherein the controlling button is a rotary button, a circumference of the controlling button being formed with a radical conic guide channel, the depth of the guide channel being tapered from one end to the other end, a resilient member being disposed in the small slide way, whereby in normal state, the resilient member lifts the link toward the button room, when the first end of the link is moved into the deeper end of the guide channel, the link being positioned in the releasing position and the second end of the link leaving the opening.

12. The grinder with easily installable/detachable grinding disc and the linkage effect as claimed in claim 1, wherein the slide way is vertically formed in the main body; the linking member being mounted under the chucking mechanism; the chucking mechanism including a chucking pillar vertically movably disposed in the slide way, the linking member being formed with a predetermined number of chucking sections, when the chucking mechanism is positioned in the engaging position, the chucking pillar being moved downward, whereby the bottom end of the chucking pillar chucks the chucking section of the linking member.

13. A grinder with easily installable/detachable grinding disc and a linkage effect, comprising:

a main body in which a rotary shaft is disposed for a grinding disc being mounted under a bottom end of the rotary shaft; a slide way being formed inside the main body;

a controlling button mounted on the main body and switchable between an activation position and a shutoff position for powering on or off the grinder;

a linking member connected with the rotary shaft and synchronously rotatable therewith; and a chucking mechanism mounted in the slide way of the main body and movable along the slide way between an engaging position and a releasing position, whereby when the chucking mechanism is moved to the engaging position, the chucking mechanism chucks the linking member, while when the chucking mechanism is moved to the releasing position, the chucking mechanism releases the linking member from the chucked state, the controlling button having a linkage function with the chucking mechanism, whereby when the controlling button is positioned in the activation position, the chucking mechanism is positioned in the releasing position and cannot be moved to the engaging position; while when the controlling button is positioned in the shutoff position, the chucking mechanism is movable between the releasing position and the engaging position where the controlling button cannot be switched to the activation position.

14. The grinder with easily installable/detachable grinding disc and the linkage effect as claimed in claim 13, wherein the chucking mechanism includes a chucking pillar and a shift button, the chucking pillar being disposed in the slide way, by means of operating the shift button, the chucking pillar being movable between the engaging position and the releasing position, whereby when the controlling button is positioned in the activation position, the chucking pillar is positioned in the releasing position and prevented from moving to the engaging position; while when the controlling button is positioned in the shutoff position, the chucking pillar is released and movable between the releasing position and the engaging position where the controlling button cannot be switched back to the activation position.

15. The grinder with easily installable/detachable grinding disc and the linkage effect as claimed in claim 14, wherein when the chucking pillar is positioned in the releasing position and the controlling button is positioned in the activation position, the chucking pillar is chucked by the controlling button; while when the controlling button is positioned in the shutoff position and the chucking pillar is positioned in the engaging position, the controlling button is chucked by the chucking pillar.

16. The grinder with easily installable/detachable grinding disc and the linkage effect as claimed in claim 15, wherein the main body is formed with a button room communicating with the slide way, the controlling button being a rotary button mounted in the button room, a recess being formed on a circumference of the controlling button, the chucking pillar having a stop section; when the controlling button is positioned in the activation position, the recess being not aligned with the chucking pillar, whereby the rotary button stops the stop section of the chucking pillar; when the rotary button is switched to the shutoff position, the recess being aligned with the chucking pillar, whereby the chucking pillar can be moved from the engaging position to the releasing position where the stop section is moved into the recess.

17. The grinder with easily installable/detachable grinding disc and the linkage effect as claimed in claim 15, wherein the main body is formed with a button room communicating with the slide way, the controlling button being a rotary button mounted in the button room, a recess being formed on a circumference of the controlling button, an arc recess being formed on a circumference of the chucking pillar; when the controlling button is positioned in the activation position, the button body of the controlling button being engaged with the arc recess, when the controlling button is positioned in the shutoff position, the recess being aligned with the chucking pillar.

* * * * *